US008255226B2

(12) United States Patent
Singhal

(10) Patent No.: US 8,255,226 B2
(45) Date of Patent: Aug. 28, 2012

(54) EFFICIENT BACKGROUND AUDIO ENCODING IN A REAL TIME SYSTEM

(75) Inventor: Manoj Singhal, B'lore (IN)

(73) Assignee: Broadcom Corporation, Irvine, CA (US)

( * ) Notice: Subject to any disclaimer, the term of this patent is extended or adjusted under 35 U.S.C. 154(b) by 909 days.

(21) Appl. No.: 11/615,252

(22) Filed: Dec. 22, 2006

(65) Prior Publication Data

US 2008/0154402 A1 Jun. 26, 2008

(51) Int. Cl.
*G10L 19/00* (2006.01)

(52) U.S. Cl. ..... 704/500

(58) Field of Classification Search ..... 704/500–504
See application file for complete search history.

(56) References Cited

U.S. PATENT DOCUMENTS

| | | | | |
|---|---|---|---|---|
| 6,310,652 | B1 * | 10/2001 | Li et al. | 348/515 |
| 6,327,691 | B1 * | 12/2001 | Huang | 714/781 |
| 6,487,535 | B1 * | 11/2002 | Smyth et al. | 704/500 |
| 6,571,055 | B1 * | 5/2003 | Sawabe et al. | 386/96 |
| 6,829,301 | B1 * | 12/2004 | Tinker et al. | 375/240.12 |
| 7,492,820 | B2 * | 2/2009 | Puri | 375/240.03 |
| 2003/0202475 | A1 * | 10/2003 | Chen et al. | 370/235 |
| 2004/0028227 | A1 * | 2/2004 | Yu | 380/201 |
| 2009/0060470 | A1 * | 3/2009 | Kurauchi | 386/124 |

* cited by examiner

*Primary Examiner* — Michael N Opsasnick
(74) *Attorney, Agent, or Firm* — Thomas, Kayden, Horstemeyer & Risley, LLP

(57) ABSTRACT

Presented herein is efficient background encoding/trancoding in a real time multimedia system. Encoding/trancoding of audio data is achieved by decoding a first audio frame; executing at least one encoding task on a second audio frame, resulting in a partially encoded second audio frame, after decoding the first audio frame; decoding a third audio frame, after executing the at least one encoding task; and executing at least another encoding task on the partially encoded second audio frame, after decoding the third audio frame.

18 Claims, 5 Drawing Sheets

Ok Please Enter /mo/ 5/4/2011

EFFICIENT BACKGROUND AUDIO ENCODING IN A REAL TIME SYSTEM

RELATED APPLICATIONS

[Not Applicable]

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

Audio decoding of compressed audio data is preferably performed in real time to provide a quality audio output. While decompressing audio data in real time can consume significant processing bandwidth, there may also be time periods where the processing core is down. This can happen if the processing core decompresses the audio data ahead of schedule beyond a certain threshold.

The down time periods may not be sufficient to encode entire audio frames. Utilization of a faster processor to allow encoding of audio data during the down time periods is disadvantageous due to cost reasons.

Further limitations and disadvantages of conventional and traditional approaches will become apparent to one of skill in the art, through comparison of such systems with some aspects of the present invention as set forth in the remainder of the present application with reference to the drawings.

BRIEF SUMMARY OF THE INVENTION

Described herein are system(s), method(s) and apparatus for efficient background audio encoding/transcoding in a real time system, substantially as shown in and/or described in connection with at least one of the figures, as set forth more completely in the claims.

These and other features and advantages of the present invention may be appreciated from a review of the following detailed description of the present invention, along with the accompanying figures in which like reference numerals refer to like parts throughout.

DETAILED DESCRIPTION OF THE INVENTION

Figure 1:
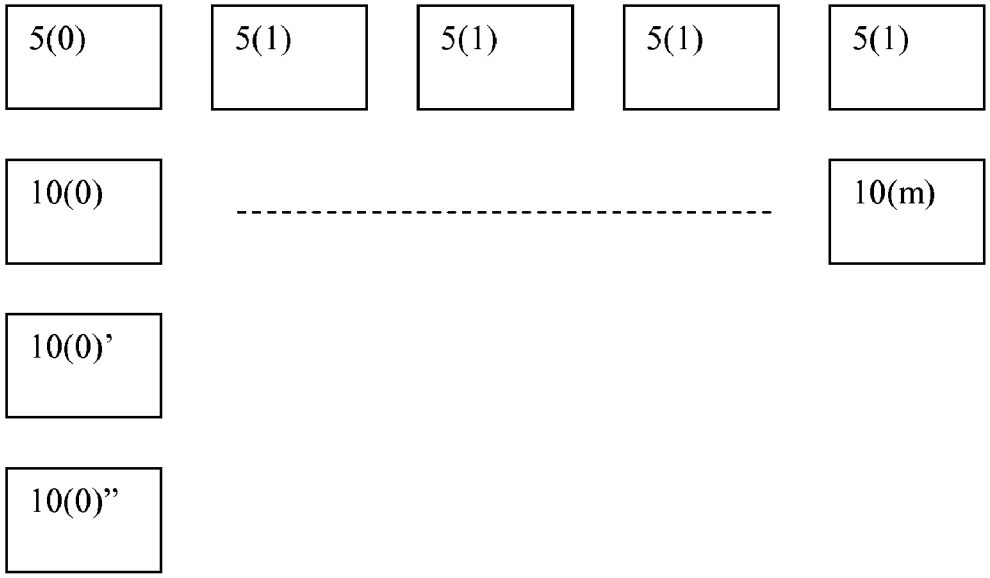
FIG. 1 is a block diagram of audio data encoded and decoded in accordance with an embodiment of the present invention.

Referring now to FIG. 1, there is illustrated a block diagram of audio data decoded and encoded/transcoded in accordance with an embodiment of the present invention. The audio data includes audio data 5 for decoding and audio data 10 for encoding.

The audio data 5 can comprise audio data that is encoded in accordance with any one of a variety of encoding standards, such as one of the audio compression standards promulgated by the Motion Picture Experts Group (MPEG). The audio data 5 comprises a plurality of frames 5(0) . . . 5(*n*). Each frame can correspond to a discrete time period.

The audio data 10 for encoding can comprise digital samples representing an analog audio signal. The digital samples representing the analog audio signal are divided into discrete time periods. The digital samples falling into a particular time period form a frame 10(0) . . . 10(*m*).

In accordance with an embodiment of the present invention, after decoding a first audio frame, e.g., audio frame 5(0), an encoding task is performed on audio frame 10(0). This results in a partially encoded audio frame 10(0).

After partially encoding the audio frame 10(0)', audio frame 5(1) is decoded. After decoding audio frame 5(1), at least another task is executed encoding the partially encoded second audio frame, 10(0)', thereby resulting in partially encoded audio frame 10(0)". After the foregoing, a third audio frame is decoded, audio frame 5(2).

It is noted that although audio frame 10(0) is partially encoded after each audio frame 5(0) . . . 5(*n*) is decoded in the foregoing embodiment, audio frame 10(0) does not necessarily have to be encoded after each audio frame in other embodiments of the present invention. Additionally, the number of audio frames that are decoded for a given format between each successive partial encoding of audio frame 10(0) are not necessarily constant and it will depend upon the number of encoding tasks scheduled in between and also the frame size and sampling rate selected for a given decode audio format.

Figure 2:
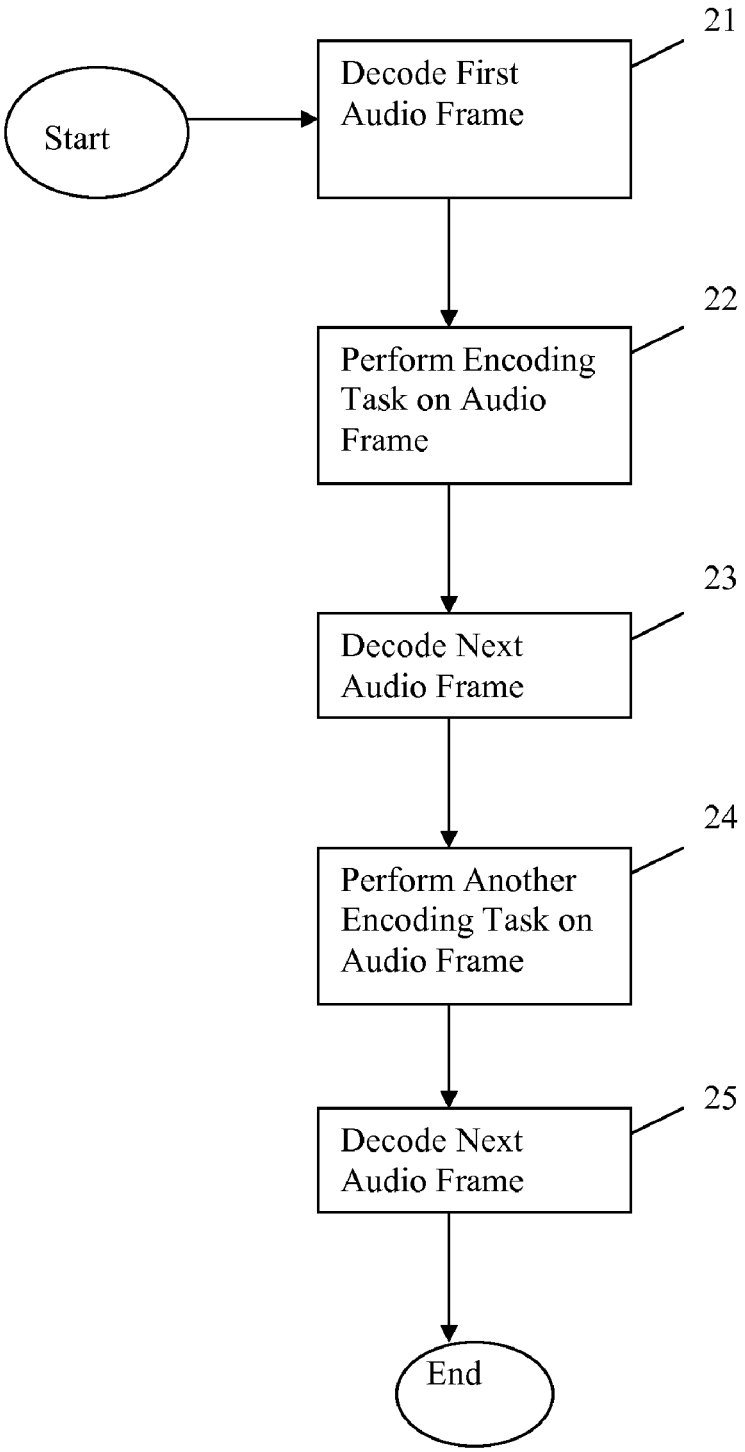
FIG. 2 is a flow diagram for encoding/transcoding and decoding audio data in accordance with an embodiment of the present invention.

Referring now to FIG. 2, there is illustrated a flow diagram for encoding and decoding audio data in accordance with an embodiment of the present invention. At 21, a first audio frame is decoded, e.g., audio frame 5(0). At 22, an encoding task is performed on audio frame 10(0), resulting in a partially encoded audio frame 10(0)'.

After partially encoding the audio frame 10(0)', at 23, audio frame 5(1) is decoded. After decoding audio frame 5(1), at 24 at least another task is executed encoding the partially encoded second audio frame, 10(0)', thereby resulting in partially encoded audio frame 10(0)". At 25, a third audio frame is decoded, audio frame 5(2).

An audio processing core for decoding audio data can also encode audio data. As noted above, audio frames 5(0) . . . 5(*m*) correspond to discrete time periods. For quality of audio playback, it is desirable to decode audio frames 5(0) . . . 5(*m*) at least a certain threshold of time prior to the discrete time period corresponding therewith. The failure to do so can result in not having audio data for playback at the appropriate time.

Where the audio data is decoded prior to the time for playback, the audio data can be stored in a buffer until the time for playback. However, if the processing core decodes the audio data too early, the buffer can overflow.

To avoid overflowing, the processing core temporarily ceases decoding the audio data beyond another threshold. This will now be referred to as "down times". During down times, the processing core can encode audio data 10. The foregoing time period may be too short to encode an entire audio frame 10(0). Therefore in certain embodiments of the present invention, the process of encoding and/or compressing audio data is divided into discrete portions. During down times, one or more of the discrete portions can be executed.

Therefore, audio frame 10(0) can be encoded over the course of several non-continuous down times as per the processing power available for encoding/transcoding.

Figure 3:
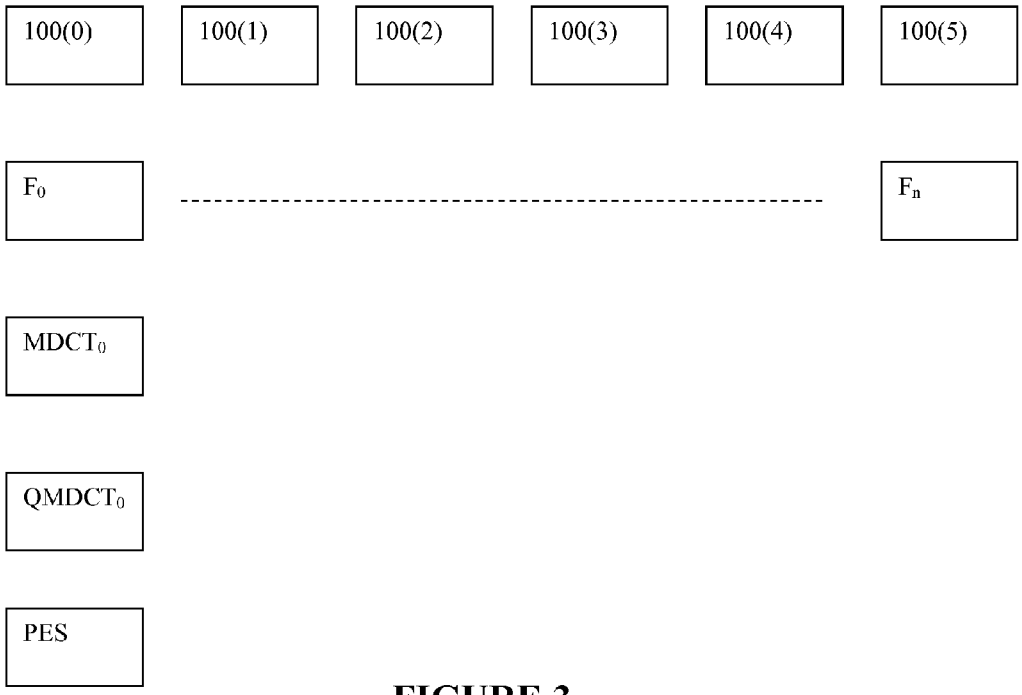
FIG. 3 is a block diagram of audio data that is encoded and compressed audio data that is decoded in accordance with an embodiment of the present invention.

Referring now to FIG. 3, there is illustrated a block diagram describing audio data 100 decoded and audio data encoded in accordance with an embodiment of the present invention. The audio data 100 comprises a plurality of frames 100(0) . . . **100(*n*)**. An audio signal for encoding may be sampled at 48K samples/second. The samples may be grouped into frames $F_0 \ldots F_n$ of 1024 samples.

After decoding frame 100(0), an acoustic model for frame $F_0$ is generated and data bits for encoding frame $F_0$ are allocated. After the foregoing, audio frame 100(1) can be decoded. After decoding audio frame 100(1), a modified discrete cosine transformation (MDCT) may be applied to frame $F_0$, resulting in a frame $MDCT_0$ of 1024 frequency coefficients 150, e.g., $MDCT_x(0) \ldots MDCT_x(1023)$.

After the foregoing, audio frame 100(2) can be decoded. After decoding audio frame 100(2), the set of frequency coefficients $MDCT_0$ may be quantized, thereby resulting in quantized frequency coefficients, $QMDCT_0$. After the foregoing, audio frame 100(3) is decoded.

After decoding audio frame 100(3), the set of quantized frequency coefficients $QMDCT_0$ can be packed into packets for transmission, forming what is known as a packetized elementary stream (PES). The PES may be packetized and padded with extra headers to form an Audio Transport Stream (Audio TS). Transport streams may be multiplexed together, stored, and/or transported for playback on a playback device. After the foregoing, audio frame 100(4) can be decoded. The foregoing can be repeated allowing for the background encoding of audio data $F_0 \ldots F_x$ while decoding audio data 100 in real time.

Figure 4:
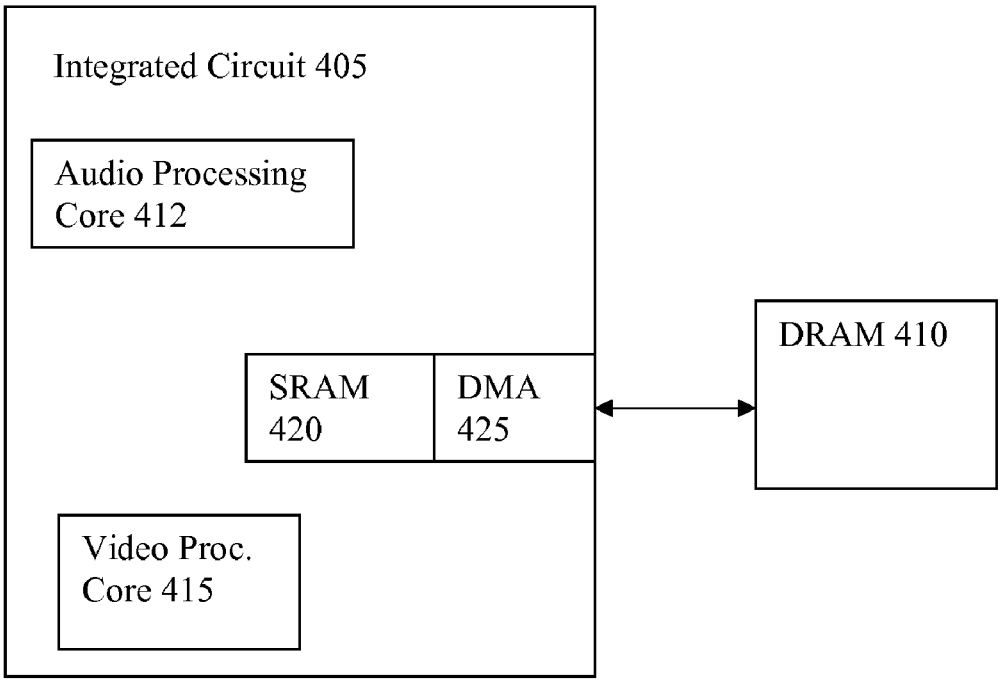
FIG. 4 is a block diagram of an exemplary circuit in accordance with an embodiment of the present invention.

Referring now to FIG. 4, there is illustrated a block diagram of an exemplary circuit 400 in accordance with an embodiment of the present invention. The circuit 400 comprises an integrated circuit 405 and dynamic random access memory 410 connected to the integrated circuit 405. The integrated circuit 405 comprises an audio processing core 412, a video processing core 415, static random access memory (SRAM) 420, and a DMA controller 425.

The audio processing core 412 encodes and decodes audio data. The video processing core 415 decodes video data. The SRAM 420 stores data associated with the audio frames that are encoded and decoded.

The audio processing core 412 decodes and encodes audio data. As noted above, audio frames correspond to discrete time periods that are desirably decoded at least a certain threshold of time prior to the discrete time period corresponding therewith. The failure to do so can result in not having audio data for playback at the appropriate time.

Where the audio data is decoded prior to the time for playback, the audio data can be stored in DRAM 410 until the time for playback. However, if the processing core decodes the audio data too early, the DRAM 410 can overflow.

To avoid overflowing, the audio processing core 412 temporarily ceases decoding the audio data beyond another threshold. During down times, the processing core can encodes audio data. As will be described in further detail below, the process of encoding and/or compressing audio data is divided into discrete portions. During down times, one or more of the discrete portions can be executed. Therefore, an audio frame can be encoded over the course of several non-continuous down times.

The SRAM 420 stores data associated with the encoded audio frames and decoded audio frames that are operated on by the audio processing core 412. About the time the audio processing core 412 switches from encoding to decoding or vice versa, the direct memory access (DMA) controller 425 copies the contents of the SRAM 420 to the DRAM 405, and copies the data associated with the audio frame that will be encoded/transcoded/decoded.

The foregoing allows for a reduction in the amount of SRAM 420 used by the audio processing core 412. In certain embodiments, the SRAM 420 can comprise no more than 20 KB. In certain embodiments, the DMA controller 425 schedules the direct memory accesses so that the data is available when the audio processing core 412 switches from encoding to decoding and vice versa.

Figure 5:
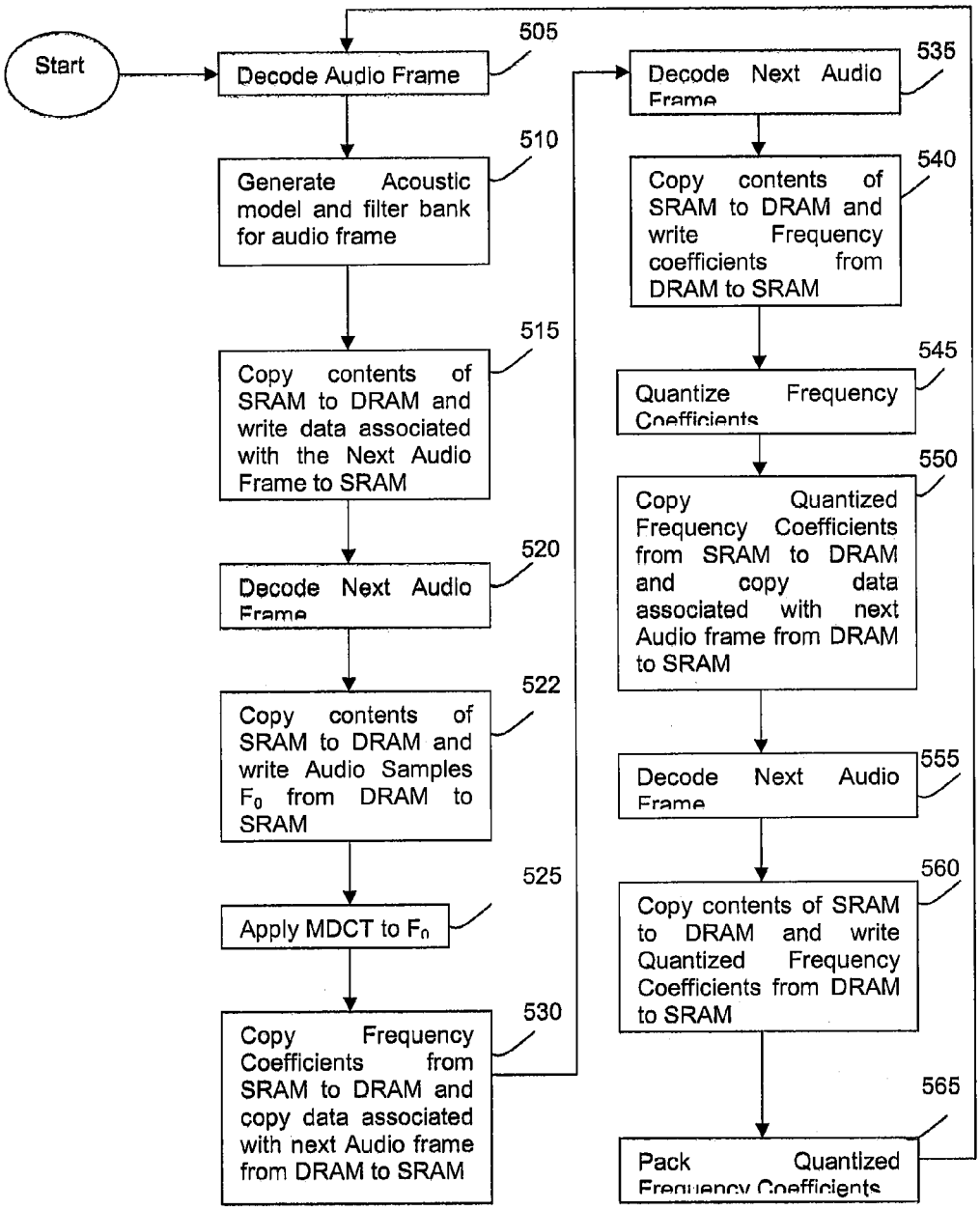
FIG. 5 is a flow diagram for encoding/transcoding audio data and decoding compressed audio data in accordance with an embodiment of the present invention.

Referring now to FIG. 5, there is illustrated a flow diagram for encoding and decoding audio data in accordance with an embodiment of the present invention. After the audio processing core 412 decodes frame 100(0) at 505, the audio processing core 412 generates an acoustic model and filter bank for an audio frame to be encoded at 510.

At 515, the DMA controller 425 copies the contents of the SRAM 420 (audio samples $F_0$) to the DRAM 405 and writes data associated with the audio frame 100(1) to the SRAM 420. At 520, audio processing core 412 decodes audio frame 100(1). At 522, the DMA controller 425 copies the contents of SRAM 420 to the DRAM 405 and writes audio samples $F_0$ from the DRAM 405 to the SRAM 420.

At 525, the audio processing core 412 applies the modified discrete cosine transformation (MDCT) to the samples $F_0$, resulting in frequency coefficients $MDCT_0$. At 530, the DMA controller 425 copies the frequency coefficients $MDCT_0$ from the SRAM 420 to the DRAM 405 and copies the data associated with audio frame 100(2) from the DRAM 405 to the SRAM 420.

At 535, the audio processing core 412 decodes audio frame 100(2). At 540, the DMA controller 425 copies the decoded audio data associated with audio frame 100(2) from the SRAM 420 to the DRAM 405 and copies the frequency coefficients $MDCT_0$ from the DRAM 405 to the SRAM 420.

At 545, the audio processing core 412 quantizes the sets of frequency coefficients $MDCT_0$, thereby resulting in quantized frequency coefficients $QMDCT_0$. At 550, the DMA controller 425 copies the quantized frequency coefficients $QMDCT_0$ from the SRAM 420 to the DRAM 405, and copies the data associated with audio frame 100(3) from the DRAM 405 to the SRAM 420.

At 555, the audio processing core 412 decodes the audio frame 100(3). At 560, the DMA controller 425 copies the decoded audio data associated with audio frame 100(3) from the SRAM 420 to the DRAM 405 and copy the quantized frequency coefficients $QMDCT_0$ from the DRAM 405 to the SRAM 420.

At 565, the audio processing core 412 packs the quantized frequency coefficients $QMDCT_0$ into packets for transmission, forming what is known as an audio elementary stream (AES). The AES may be packetized and padded with extra headers to form an Audio Transport Stream (Audio TS). Transport streams may be multiplexed together, stored, and/or transported for playback on a playback device.

The embodiments described herein may be implemented as a board level product, as a single chip, application specific integrated circuit (ASIC), or with varying levels of the system integrated with other portions of the system as separate components. Alternatively, if the processor is available as an ASIC core or logic block, then the commercially available processor can be implemented as part of an ASIC device wherein certain aspects of the present invention are implemented as firmware.

The degree of integration may primarily be determined by the speed and cost considerations. Because of the sophisticated nature of modern processors, it is possible to utilize a commercially available processor, which may be implemented external to an ASIC implementation.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

The invention claimed is:

1. A method for encoding audio data, said method comprising:

decoding compression of a first audio frame with a processing core;

executing at least one compression task on a second audio frame, said at least one compression task resulting in a partially compressed second audio frame, after decoding compression of the first audio frame with the processing core;

decoding compression of a third audio frame, after executing the at least one compression task with the processing core; and executing at least another compression task on the partially compressed second audio frame, after decoding compression of the third audio frame with the processing core.

2. The method of claim 1, wherein the at least one encoding task comprises at least one task selected from a group consisting of:

modeling acoustic characteristics of the second audio frame; and allocating bits for the second audio frame.

3. The method of claim 1, wherein the at least another encoding task further comprises at least one task selected from a group consisting of:

transforming the partially encoded audio frame to frequency domain coefficients; and quantizing the frequency domain coefficients.

4. The method of claim 1, further comprising:

decoding a fourth audio frame after executing the another at least one encoding task; and executing at least one other encoding task after decoding the fourth audio frame, wherein said at least one other encoding task comprises packing the second audio frame.

5. The method of claim 1, further comprising:

overwriting data associated with the second audio frame with data associated with the third audio frame; and overwriting data associated with the third audio frame with data associated with the second audio frame.

6. The method of claim 5, further comprising:

copying the data associated with the second audio data frame.

7. The method of claim 1, wherein decoding the first audio frame further comprises decompressing the first audio frame, and wherein encoding the second audio frame further comprises compressing the second audio frame.

8. A circuit for encoding audio data, said circuit comprising:

a processing core for decoding compression of a first audio frame;

said processing core executing at least one compression task on a second audio frame, said at least one compression task resulting in a partially compressed second audio frame, after decoding the first audio frame;

said processing core decoding compression of a third audio frame, after executing the at least one compression task; and said processing core executing at least another compression task on the partially compressed second audio frame, after decoding compression of the third audio frame.

9. The circuit of claim 8, wherein the at least one encoding task comprises at least one task selected from a group consisting of:

modeling acoustic characteristics of the second audio frame; and allocating bits for the second audio frame.

10. The circuit of claim 8, wherein the at least another encoding task further comprises at least one task selected from a group consisting of:

transforming the partially encoded audio frame to frequency domain coefficients; and quantizing the frequency domain coefficients.

11. The circuit of claim 8, wherein the processing core decodes a fourth audio frame after executing the another at least one encoding task; and executes at least one other encoding task after decoding the fourth audio frame, wherein said at least one other encoding task comprises packing the second audio frame.

12. The circuit of claim 8, further comprising:

a first memory for storing data associated with the second audio frame and data associated with the third audio frame, wherein the data associated with the second audio frame overwrites the data associated with the third audio frame, and wherein the data associated with the third audio frame overwrites that data associated with the second audio frame.

13. The circuit of claim 12, wherein the first memory comprises static random access memory.

14. The circuit of claim 13, wherein the static random access memory consists of less than 25 kilobytes.

15. The circuit of claim 12, further comprising:

a DMA controller for copying the data associated with the second audio data frame to a second memory.

16. The circuit of claim 15 wherein the direct memory access controller copies the data associated with the second audio data frame to a dynamic random access memory.

17. The circuit of claim 15, wherein the circuit comprises an integrated circuit, and wherein the integrated circuit comprises the processing core, the static random access memory and the DMA controller.

18. The circuit of claim 17, wherein the integrated circuit comprises another processing core, wherein the another processing core decodes video data.

* * * * *